US011377239B2

(12) United States Patent
Cassoli et al.

(10) Patent No.: US 11,377,239 B2
(45) Date of Patent: Jul. 5, 2022

(54) PROCESS FOR OPERATING A MACHINE FOR WRAPPING PRODUCTS WITH A THERMOPLASTIC FILM

(71) Applicant: CPS Company S.r.l., Casalecchio di Reno (IT)

(72) Inventors: Stefano Cassoli, Casalecchio di Reno (IT); Marco Cassoli, Casalecchio di Reno (IT)

(73) Assignee: CPS Company S.r.l., Province of Bologna (IT)

( * ) Notice: Subject to any disclaimer, the term of this patent is extended or adjusted under 35 U.S.C. 154(b) by 49 days.

(21) Appl. No.: 16/617,845

(22) PCT Filed: May 30, 2018

(86) PCT No.: PCT/IB2018/053846
§ 371 (c)(1),
(2) Date: Nov. 27, 2019

(87) PCT Pub. No.: WO2018/220551
PCT Pub. Date: Dec. 6, 2018

(65) Prior Publication Data

US 2020/0189774 A1 Jun. 18, 2020

(30) Foreign Application Priority Data

Jun. 1, 2017 (IT) ..... 102017000060353

(51) Int. Cl.
*B65B 9/213* (2012.01)
*B65B 25/14* (2006.01)
(Continued)

(52) U.S. Cl.
CPC ..... *B65B 9/213* (2013.01); *B65B 25/146* (2013.01); *B65B 51/30* (2013.01); *B65B 59/001* (2019.05); *B65B 61/06* (2013.01); *B65B 63/02* (2013.01)

(58) Field of Classification Search
CPC ..... B65B 9/213; B65B 59/001; B65B 25/146; B65B 51/30; B65B 61/06; B65B 63/02
(Continued)

(56) References Cited

U.S. PATENT DOCUMENTS 4,679,379 A * 7/1987 Cassoli ..... B65B 63/02 414/789.2
4,715,166 A * 12/1987 Kameda ..... B29C 65/305 53/550
(Continued)

FOREIGN PATENT DOCUMENTS

WO WO2010141663 12/2010
WO WO2017009737 1/2017

OTHER PUBLICATIONS

Patent Cooperation Treaty, International Search Report and Written Opinion for International Application No. PCT/IB2018/053846, dated Jul. 31, 2018, 10 pages.

*Primary Examiner* — Anna K Kinsaul
*Assistant Examiner* — Luis G Del Valle
(74) *Attorney, Agent, or Firm* — Stetina Brunda Garred and Brucker

(57) ABSTRACT

A working process of a machine for wrapping products in packages, carried out with a thermoplastic material film from a reel, the process comprising: reducing a transversal section of a hollow mandrel to be smaller than a transversal dimension of a bundle of products, positioning a sealing device in a position for sealing overlapped longitudinal edges of the film while forming a new tubular film casing, arranging two vertically mobile elements of a sealing and
(Continued)

transversal cutting assembly in a closure position on the head portion of the new tubular film casing and on the tail portion of the tubular film casing of a finished package, and conveying the new tubular film casing away from the mandrel, and repeating the process so that the product placed inside the tubular casing by the mandrel is wrapped in a tight adherent manner due to the elastic retraction of the film.

8 Claims, 5 Drawing Sheets

(51) Int. Cl.
*B65B 51/30* (2006.01)
*B65B 61/06* (2006.01)
*B65B 63/02* (2006.01)
*B65B 59/00* (2006.01)

(58) Field of Classification Search
USPC ..... 53/439
See application file for complete search history.

(56) References Cited

U.S. PATENT DOCUMENTS 5,189,864 A * 3/1993 Cinotti ..... B65B 25/14 53/228
5,329,745 A * 7/1994 Suga ..... B65B 9/067 53/550
5,400,569 A * 3/1995 Jones ..... B65B 63/028 53/529
5,447,012 A * 9/1995 Kovacs ..... B65B 25/14 53/436
5,653,085 A * 8/1997 Suga ..... B29C 66/91212 53/550
2003/0159401 A1* 8/2003 Sorenson ..... B65B 59/003 53/374.6
2007/0272788 A1* 11/2007 De Matteis ..... B65B 51/023 242/521
2009/0120045 A1* 5/2009 Gorrieri ..... B65B 59/001 53/543
2009/0139185 A1* 6/2009 Gorrieri ..... B65B 25/146 53/251
2015/0329230 A1* 11/2015 Rasi ..... B65B 5/06 53/147

* cited by examiner

PROCESS FOR OPERATING A MACHINE FOR WRAPPING PRODUCTS WITH A THERMOPLASTIC FILM

CROSS-REFERENCE TO RELATED APPLICATIONS

The present application claims priority to PCT International Application No. PCT/IB2018/053846 filed on May 30, 2018, which claims priority to Italian Patent Application No. 102017000060353 filed on Jun. 1, 2017, the entirety of the disclosures of which are expressly incorporated herein by reference.

STATEMENT RE: FEDERALLY SPONSORED RESEARCH/DEVELOPMENT

Not applicable

BACKGROUND

The subject of the present invention is an operating process of a wrapping machine for products, in particular paper products, of non-woven fabrics or the like, for producing packages with a film of thermoplastic material unwound from a reel.

The machine subject of the present patent application has the aim of enabling a rapid packaging of products with efficient seals, thanks to the use of appropriate pressing devices provided in the sealing and transversal cutting assembly of the tubular film wrapping, said assembly being mounted on a mobile carriage which, with means adapted to move further away from and closer to the mandrel with tie elements that produces said tubular wrapping, with an operating sequence such that, while a new tubular package is pulled forward by the sealing and cutting assembly provided with pressing devices, sealing the head of said package and the tail of the package downstream, said new package is quickly filled with products by a pusher, avoiding the risk of the seal breaking due to the pressure of the air trapped in the same package in front of the product, thanks to the presence of one of the aforementioned pressing devices which isolates the seal from the effect of said pressure of the air.

However, the product packages made with the machine described above have the drawback that the film is relatively loose and therefore does not adhere to the packaged products in an optimal manner.

The present invention intends to overcome this drawback with an operating process that allows packages to be achieved wherein the tubular wrapping of film intimately adheres to the products placed within the package and this brings several advantages, and in particular a minimum use of film, an improved aesthetic appearance of the package and the possibility of packaging rigid products, such as for example, boxes for paper towels, without having to resort to a supplementary thermal shrinkage step, which is a step currently being used, with savings in production costs and a reduction in operating times.

BRIEF DESCRIPTION OF THE DRAWINGS

Further characteristics and advantages of the process according to the invention and the apparatus for its implementation, will become clearer from the following description made with reference to the five tables of figures of the attached drawings, wherein.

DETAILED DESCRIPTION

Figure 1:
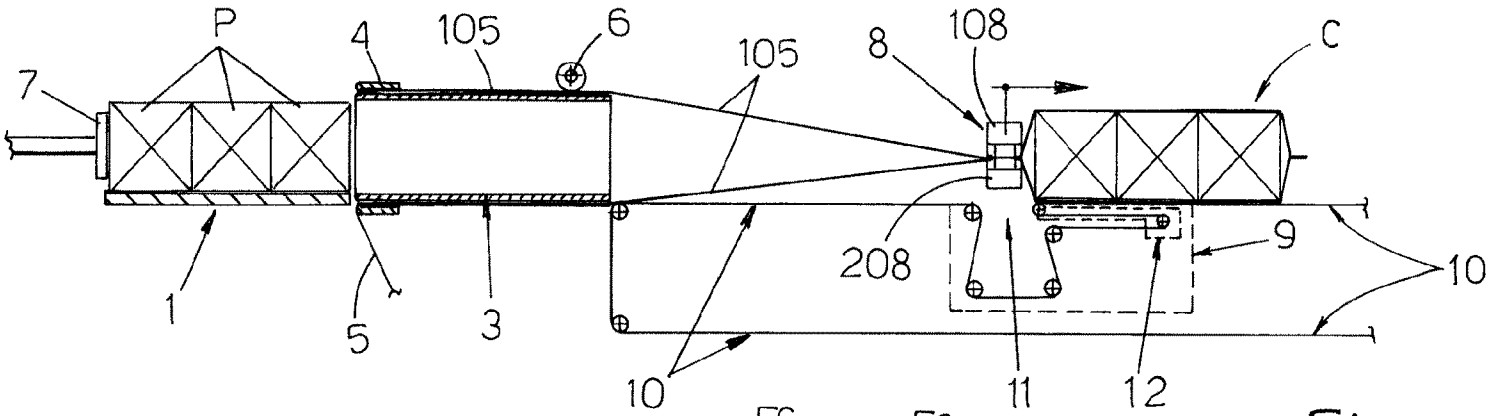
FIGS. 1 and 2 are respectively schematic lateral elevation and top plan views of the components of the wrapping machine, illustrated during a first working step.
Figure 3:
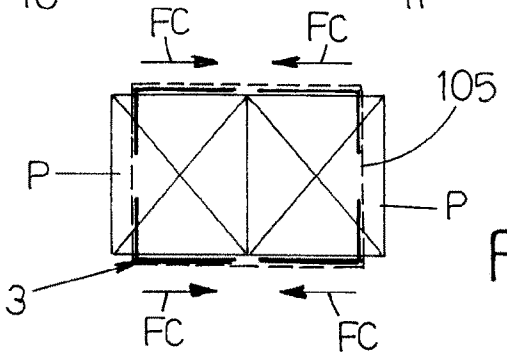
FIG. 3 is a schematic and transversal section view of an area of the mandrel that produces the tubular wrapping of film, shown along the line III-III of FIG. 2 that illustrates the mandrel in a closed position, with a reduced transversal profile.
Figure 2:
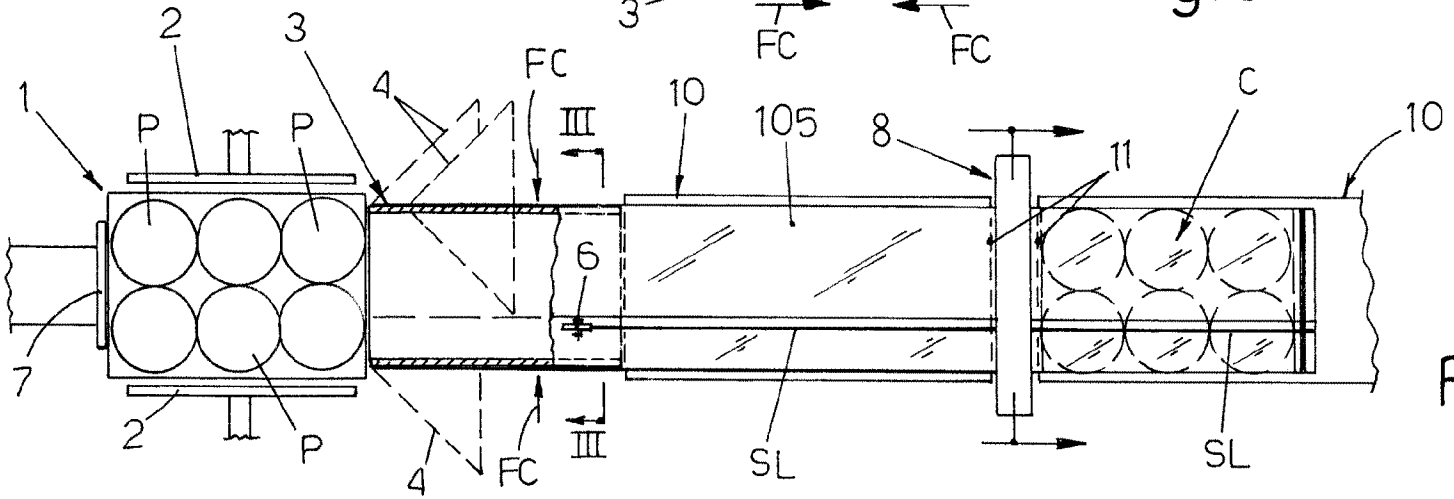

With reference firstly being made to FIGS. 1 to 3 of the drawings, the number 1 denotes a loading station of a known type, in which products P are placed, such as for example rolls of toilet paper, rolls of paper towels for the kitchen, packs of serviettes, paper towels, boxes for paper towels and the like, which are grouped and/or stacked together to form the bundle to be packaged.

Said station 1, can be adjusted according to the shape of the packages to be produced, and is provided with means 2 for aiding to slightly compress the bundle of products so as to ease their insertion into the mandrel 3 that forms the tubular wrapping of film by means of an appropriate pusher, as will be better described in the following.

The mandrel 3, is arranged immediately downstream of the loading station 1, it is provided with means 4 shaped as a forming shoulder and is axially hollow with a preferably rectangular shaped transversal profile and can be adjusted with known means and, together with the forming shoulder 4, for adapting to the shape/size of the packages to be made.

The film 5 coming from a reel not illustrated, thanks to known guide means, assumes a tubular shape 105 entering from the left end of the mandrel 3, for those who are looking at the figures, running longitudinally and outside along the mandrel itself with longitudinal lengths of the film being partially overlapped and joined thanks to a longitudinal seal SL made by an appropriate sealing device 6 so that when the same film exits the mandrel it takes on the shape of the tubular casing.

A pusher 7, thanks to appropriate actuating means, can slide horizontally for pushing the bundle of products P from the loading station 1 through the mandrel 3 and outside of the mandrel itself so as to arrive at the working area of a transversal sealing and cutting assembly 8, mounted on a carriage 9 which is also horizontally mobile with appropriate means, said assembly also carrying pressing devices which pinch the ends of the tubular film casing for conveying the latter away from the mandrel.

Said assembly 8 is formed by two elements 108 and 208 both vertically mobile with a self-centering movement.

Downstream of the mandrel there is a conveyor 10, the packages that exit the mandrel are arranged on the top branch of this conveyor and on said top branch, at the area of the vertical working plane of the elements 108, 208 of the sealing and cutting assembly 8 a transversal opening 11 is provided which, during the working steps of the machine can be open or closed due to the presence of a secondary carriage 12 mounted on the primary carriage 9 and provided with a horizontal movement independent from the movement of said primary carriage and capable of opening and closing said opening 11.

FIGS. 1 and 2 illustrate the working step of the machine in which a bundle of products P is positioned in the loading station 1 and the mandrel 3 is closed, in the direction indicated by the arrows FC of FIG. 3, so as to have an appropriately reduced transversal section in respect to the overall transversal dimensions of the bundle.

For carrying out said adjustment of the mandrel 3 and its forming shoulder 4, the same means are used, of a known type and not shown, for the adjustment of the mandrel itself according to the shape/size of the products to be packaged.

In this step, with the sealing device 6 in an active working position for performing the longitudinal seal SL of the superimposed edges of the film, the assembly 8 conveyed by the primary carriage 9 with the closed elements 108, 208 has arrived at the end stop position to the right, for those who are looking at the figures, dragging the newly formed tubular casing away from the mandrel 3 and performing the seal ST2 and the transversal cut of the tail of a last completed package C and simultaneously performing the seal ST1 of the head end of the tubular film casing, which is still empty and ready to house the new bundle present in the loading station.

Figure 4:
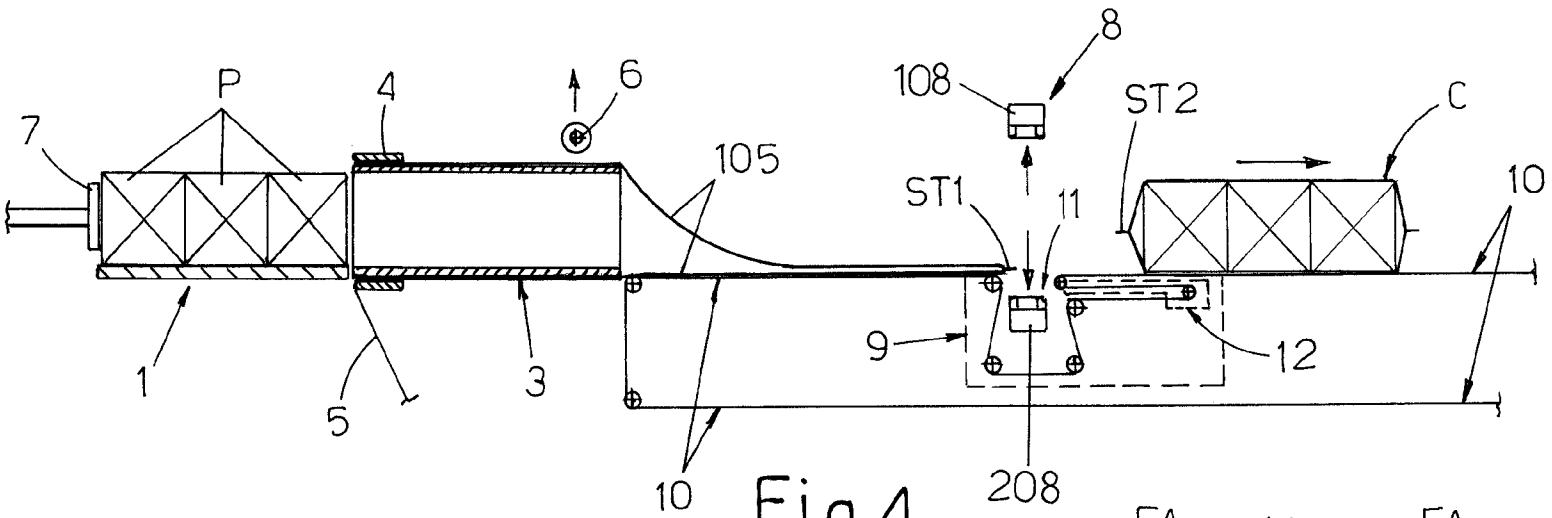
FIGS. 4 and 5 are respectively schematic lateral elevation and top plan views of a subsequent working step of the wrapping machine.
Figure 6:
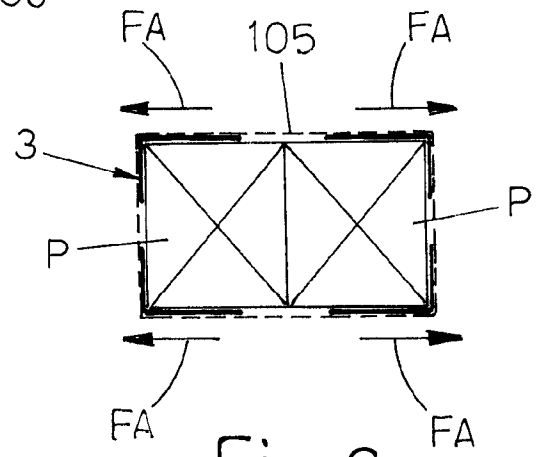
FIG. 6 is a transversal section of the mandrel shown along the line VI-VI of FIG. 5, which illustrates the mandrel in an open position having a wider transversal profile.
Figure 5:
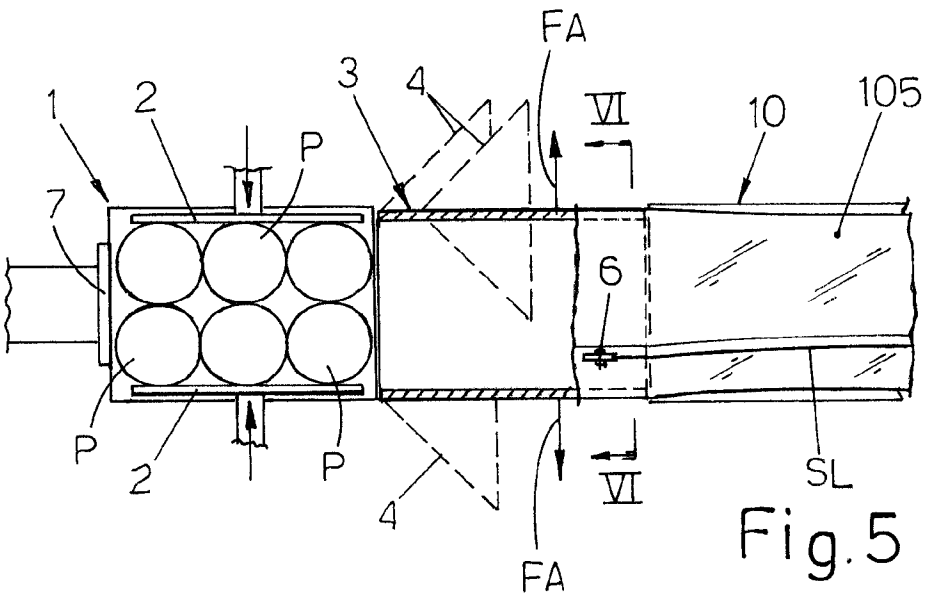

In FIGS. 4 and 5 a subsequent working step is illustrated wherein the elements 108, 208 of the assembly 8 are opened, the completed package C starts to move away from the top branch being unloaded from the conveyor 10, the sealing device 6 is arranged in a rest position and the mandrel 3 opens transversally, in the direction indicated by the arrows FA of FIG. 6, by appropriately widening the length of the tubular film casing arranged outside the mandrel itself without encountering any risk of breakage due to the elastic properties of the thermoplastic film.

Figure 7:
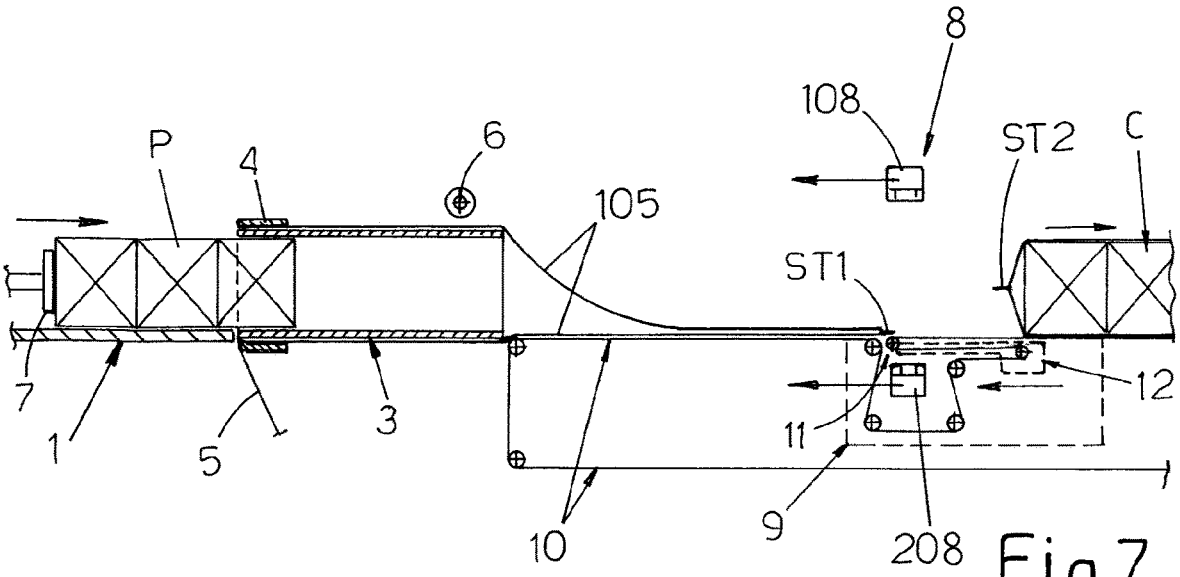
FIGS. 7 to 10 schematically illustrate subsequent working steps of the wrapping machine.

The means 2 which intervene in rapid succession and according to a known solution, perform a slight compression of the bundle of products P present in the loading station to an extent that allows them to be inserted in the mandrel thanks to the advancing of the pusher 7 as illustrated in the operating step of FIG. 7.

In said step, the secondary carriage 12 intervenes to almost completely close the transversal opening 11 of the top branch of the conveyor 10 so as to appropriately support the new package that will be subsequently produced and the primary carriage 9 and the assembly 8 connected thereto, start their step of retracting towards the mandrel 3, while the finished package C is externally unloaded.

Figure 8:
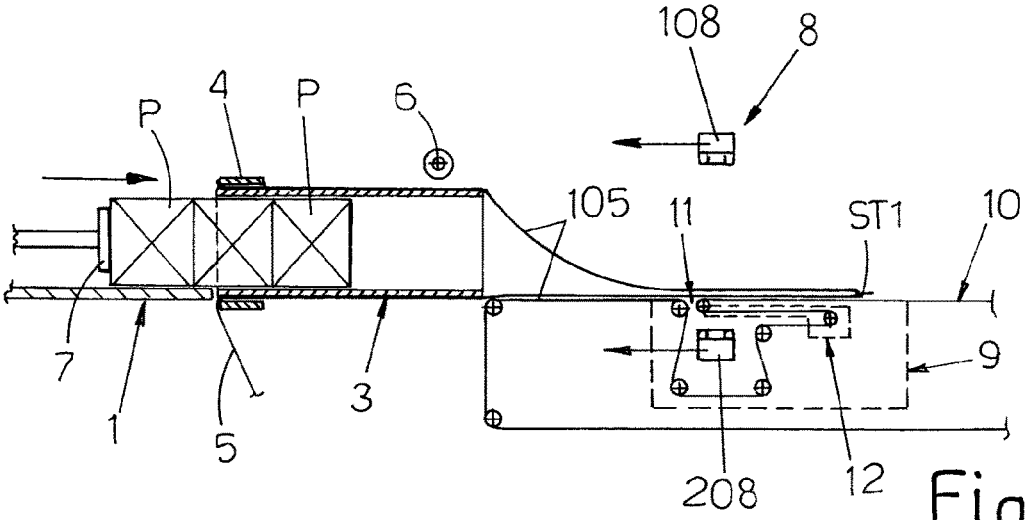

FIG. 8 illustrates an intermediate working step wherein the pusher 7 advances towards the right continuing the insertion of the bundle of products P inside the mandrel 3, while the primary carriage 9 and the assembly 8 continue to retract back towards the mandrel 3, with the opening 11 that remains in a closed position.

Figure 9:
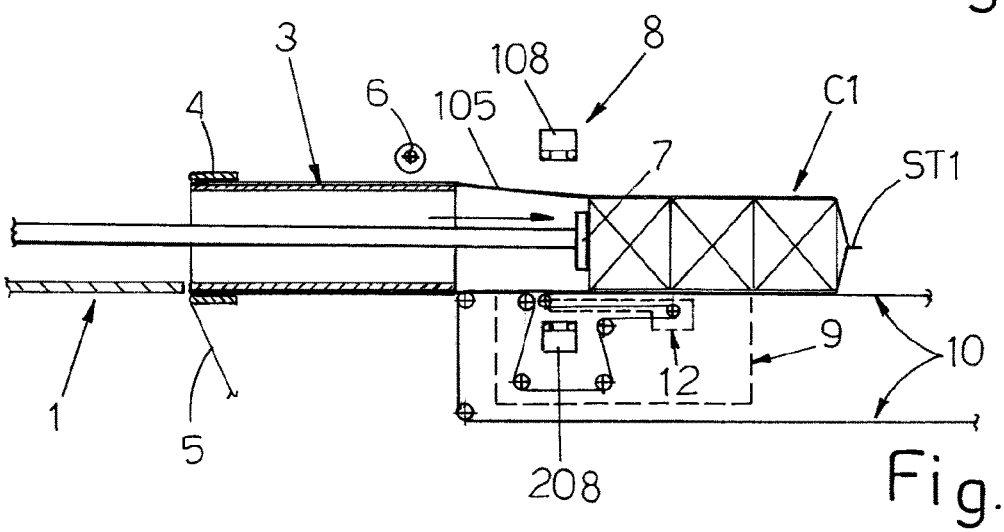

In FIG. 9 a processing step of the machine is illustrated in which, the pusher 7 has arrived at the end stop pushing, during its advancing, the bundle of products P of the new package C1 against the head end of the tubular film casing, closed by the transversal seal ST1, while the carriage 9 and the assembly 8 have arrived at the end of their retraction in proximity to the mandrel 3.

Figure 10:
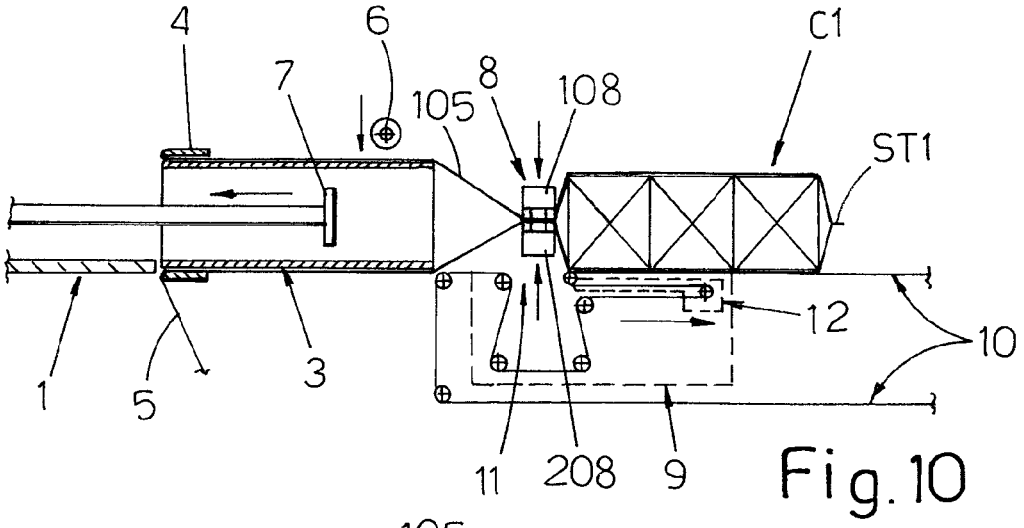
Figure 11:
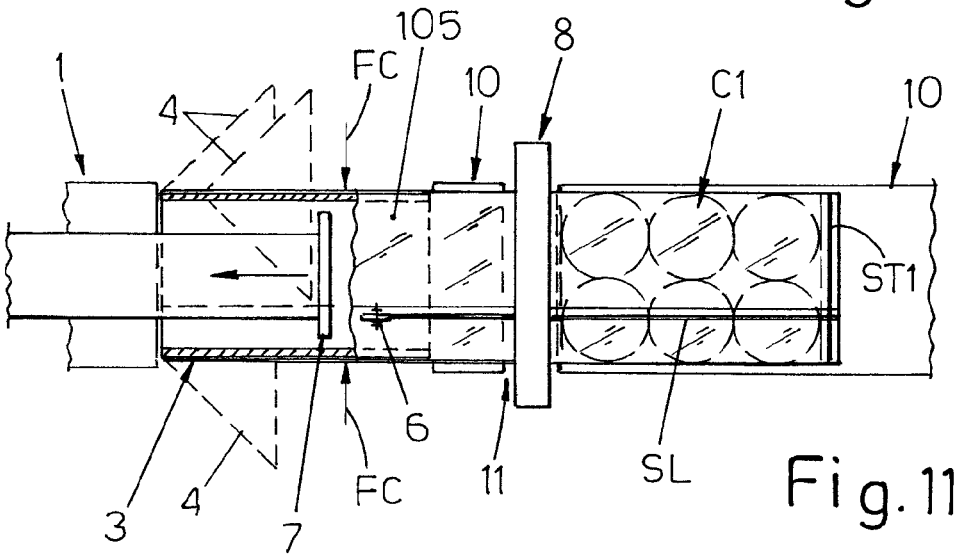
FIG. 11 schematically illustrates in a top plan view the working step of the machine of FIG. 10.

In FIGS. 10 and 11 a working step is illustrated wherein, the secondary carriage 12 goes to a backwards position towards the right, for widening the opening 11 of the top branch of the conveyor 10 thus freeing the operating space for the vertical and auto-centering movement of the elements 108, 208 of the sealing and cutting assembly 8 provided with pressing devices.

Before the intervention of said elements 108, 208, on the sides of the tubular film casing between the mandrel and the new package C1, lateral folding units, which are not illustrated, intervene to make recessed bellows, as is known in the art.

In rapid succession the elements 108, 208 close with an auto-centering movement, by pinching the rear end of the new package C1.

In this step said elements 108, 208 can be partially closed, using only the pressing devices, which pinch the film, or can be completely closed, thus immediately achieving the seal ST2 of the tail of the package C1, the seal ST1 of the head of the new tubular film casing and the relative cut between said seals.

In the same operating step the mandrel 3 is transversally closed returning to the configuration illustrated in FIG. 3 and the pusher 7 starts to retract through the mandrel itself so as to reach the position upstream of the loading station 1 of the products P.

Figure 12:
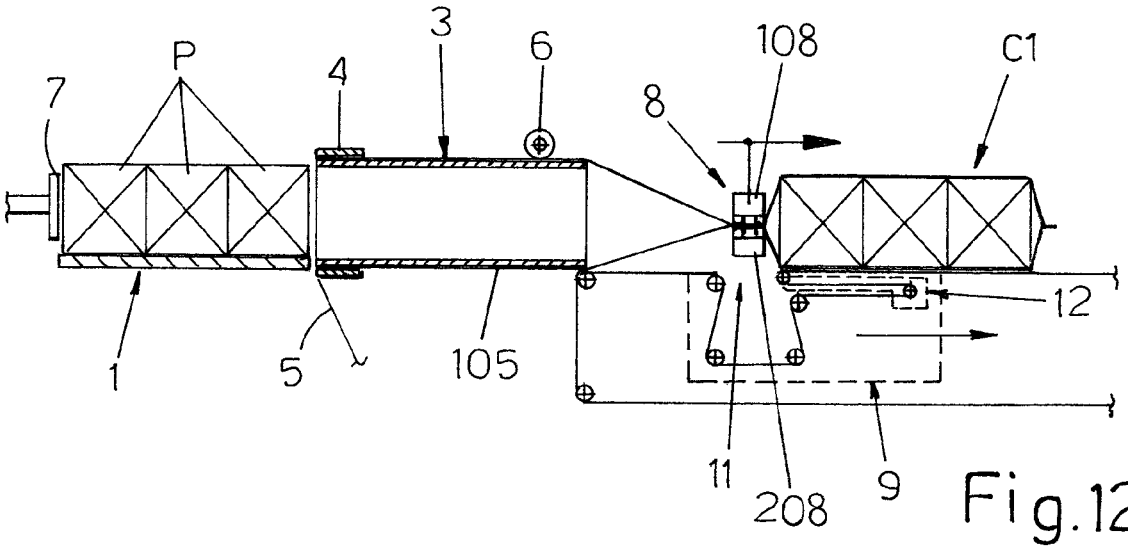
FIGS. 12 and 13 are respectively schematic lateral elevation and top plan views which illustrate a further working step of the machine.
Figure 13:
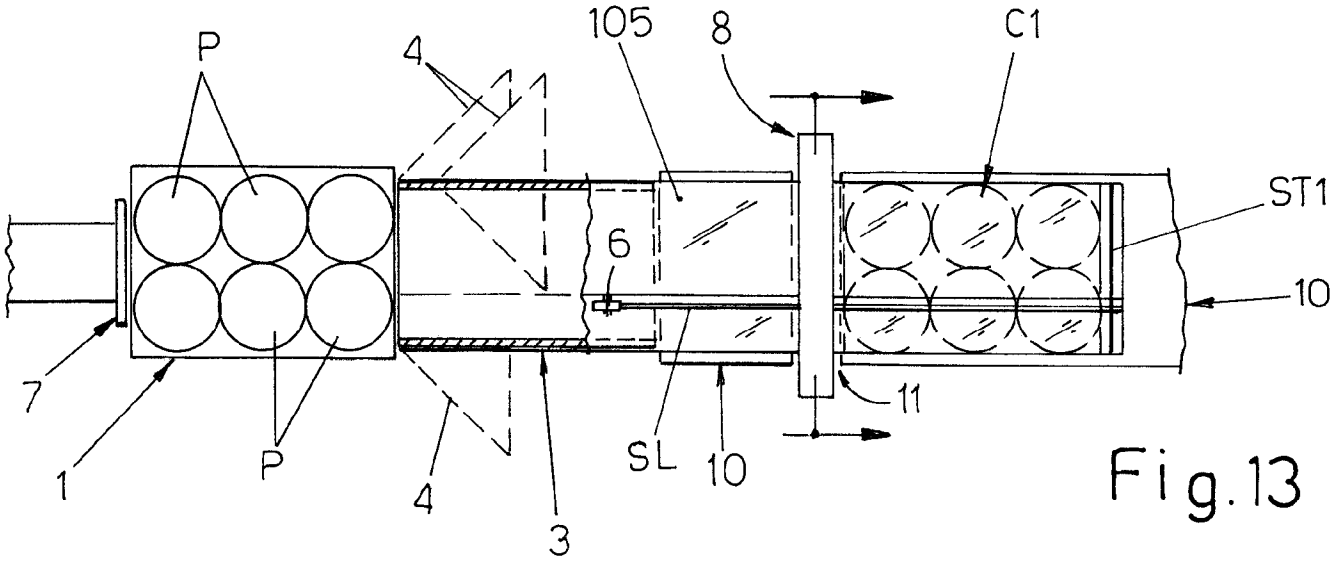

In FIGS. 12 and 13 a further operating step is illustrated wherein, the longitudinal sealing device 6 returns to its active working position and the elements 108, 208 in a closed position, advance towards the right, for those who are looking at the figures, dragging the empty tubular film casing and during said travel, in the case that the same elements are only partially closed, only by active pressing devices, the sealing and cutting operation of the film is carried out by means of appropriate components present in the same elements 108, 208.

In the same working step, products P of a new bundle to be packaged are positioned in the loading station 1, and the cycle is repeated by returning to the operating step of FIG. 1.

Purely by way of example in the drawings, a mandrel 3 is illustrated in a schematic manner, formed by four guide elements with angular profiles, but it should be understood that according to the shape/size of the products to be packaged, the mandrel can also be provided with further flat guide elements arranged at the centre of each side of the mandrel itself.

Figure 14:
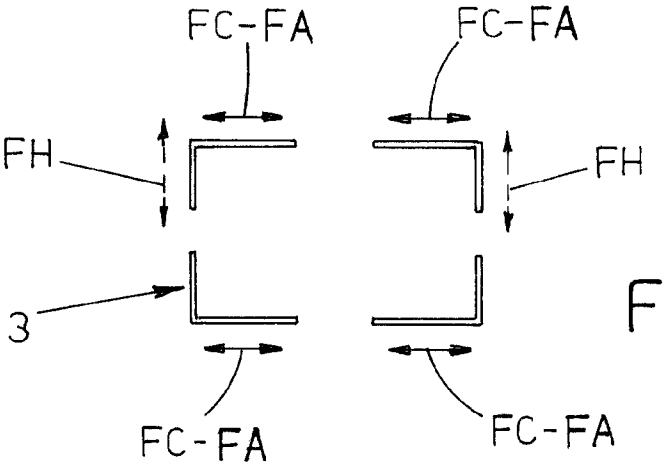
FIG. 14 is a transversal and schematic view of the mandrel of the machine that produces the film tubular wrapping.

In the process, according to the present invention a preferred embodiment is described wherein for the forming of the tubular film casing with a reduced transversal profile, a movement of the elements that formed the mandrel 3 only in the transversal direction, as indicated by the arrows FC and FA in the FIGS. 3, 6 and 14, but it should be understood that according to a further implementation variation, for achieving an even narrower tubular film casing, said elements that form the mandrel can also be height adjusted, at least with its top components, as indicated by the arrows FH of FIG. 14.

The process according to the present invention can be used on a wrapping machine provided with both a mandrel formed by elements that do not provide channels, and with a mandrel with elements that provide longitudinal channels used to rapidly extract the pressurised air that tends to form in the package during the insertion therein of the products to be packaged.

Said second embodiment provides for the use of a mandrel provided with channels for expelling the air towards the outside of the packages, is subject of the patent application n. 102015000077005 in the name of the same applicant.

It should be understood that the process described herein can be subject to all these modifications, while remaining within the scope of protection of the present invention, as described, illustrated and as claimed in the following.

The invention claimed is:

1. A working process of a machine for wrapping products in packages, carried out with a thermoplastic material film from a reel, comprising:

a loading station for the products to be packaged;

a hollow mandrel with a relative forming shoulder;

a sealing device for forming a seal of the longitudinal edges of the film;

a horizontally mobile pusher for pushing a bundle of products from the loading station through the mandrel;

a sealing and transversal cutting assembly formed by two vertically mobile elements mounted on a horizontally mobile primary carriage;

a conveyor; and a secondary carriage carried by the primary carriage;

the working process comprising the following operating steps:

adjusting the mandrel to reduce a transversal section of the mandrel to be smaller than a transversal dimension of the bundle of products;

positioning the sealing device in a position for sealing the overlapped longitudinal edges of the film while forming a new tubular film casing;

arranging the elements of the assembly in a closed position on the head portion of the new tubular film casing and on the tail portion of the tubular film casing of a finished package;

and conveying of said new tubular film casing, by the movement of the primary carriage away from the mandrel, and repeating the preceding steps so that the product placed inside the tubular casing by the mandrel is wrapped in a tight adherent manner due to the elastic retraction of the film of tubular casing, characterized in that when the sealing and cutting assembly is in the stop end position away from the mandrel, the longitudinal sealing device is in the rest position, the elements of the assembly open, and the mandrel is adjusted to transversally widen, appropriately widening the length of the tubular film casing arranged outside of the mandrel itself and the bundle of products present in the loading station is slightly compressed to allow the bundle to enter inside the mandrel, and that prior to the intervention step of closing the elements that pinch the tubular film casing, the mandrel is adjusted to transversally reduce and the pusher starts the step of moving backwards so as to arrive upstream of the loading station so it can start a new packaging cycle.

2. The process according to claim 1, characterized in that in the start position next to the mandrel, the elements of the sealing and cutting assembly partially closes with only the active pressing devices pinching the film, and the sealing operations of the tail of the finished package, and the seal of the head of the new tubular film casing and the relative cut between the two seals are performed while the assembly is moving away from the mandrel.

3. The process according to claim 1, characterized in that in the start position next to the mandrel the elements of the assembly completely closed, achieving the seal of the tail of the finished package, the seal of the head of the new tubular film casing and the relative cut between the two seals.

4. The process according to claim 1 characterized in that during the retraction step of the primary carriage towards the mandrel, the secondary carriage intervenes to almost completely close the transversal opening of the top branch of the conveyor, so that the new package subsequently produced can be correctly supported by the conveyor and the primary carriage and the assembly connected thereto, begin their retraction step towards the mandrel while the pusher advances, pushing the bundle of products inside the mandrel itself.

5. The process according to claim 4 characterized in that when the pusher has arrived at the end stop, advancing and pushing the bundle of products of the new package against the head end of the tubular film casing closed by the transversal seal and the carriage and the assembly have both arrived at the end of their retraction in the proximity of the mandrel, the secondary carriage goes to a backwards position towards the right for widening the opening of the top branch of the conveyor thus freeing the operating space for the vertical and auto-centering movement of the elements of the sealing and cutting assembly equipped with pressing devices and, before the intervention of said elements, on the sides of the tubular film casing between the mandrel and the new package lateral folding units intervene which make recessed bellows.

6. The process according to claim 5, characterized in that for achieving an even narrower tubular film casing, the elements that form the mandrel must be adjusted in height, at least with its upper components.

7. The process according to claim 1, characterized in that the modifications for closing and opening the transversal section of the mandrel are achieved according to the shape/size of the products to be packaged.

8. The process according to claim 1, characterized in that the process can be applied on both a wrapping machine provided with a mandrel that does not have channels and a wrapping machine provided with a mandrel that has longitudinal channels used to quickly expel the pressurized air that tends to form in the packages during the insertion of the product to be packaged therein.

* * * * *